US005852992A

United States Patent [19]

Boggs et al.

[11] Patent Number: 5,852,992

[45] Date of Patent: Dec. 29, 1998

[54] INTERNAL COMBUSTON ENGINE HAVING SEPARATED CYLINDER HEAD OIL DRAINS AND CRANKCASE VENTILATION PASSAGES

[75] Inventors: David Lee Boggs, Bloomfield Hills; Daniel James Baraszu, Plymouth, both of Mich.; David Mark Foulkes, Erfstadt, Germany; Enio Goyannes Gomes, Ann Arbor, Mich.

[73] Assignee: Ford Global Technologies, Inc., Dearborn, Mich.

[21] Appl. No.: 976,940

[22] Filed: Nov. 24, 1997

[51] Int. Cl.[6] ..... F01M 1/00

[52] U.S. Cl. ..... 123/196 R; 123/41.86; 123/196 CP; 123/196 N; 184/18; 184/6.8; 184/6.5

[58] Field of Search ..... 123/90.33, 41.86, 123/196 R, 196 LP, 196 M, 196 V; 184/18, 6.8, 6.5

[56] References Cited

U.S. PATENT DOCUMENTS

| | | | |
|---|---|---|---|
| 1,004,095 | 9/1911 | Simon | 123/62 |
| 1,969,690 | 8/1934 | Church | 184/6.5 |
| 2,996,050 | 8/1961 | Caris | 123/41.72 |
| 4,501,234 | 2/1985 | Toki et al. | 123/41.86 |
| 4,587,933 | 5/1986 | Shaw | 123/41.67 |
| 4,771,745 | 9/1988 | Nakamiura et al. | 123/196 R |
| 4,773,366 | 9/1988 | Sedl et al. | 123/196 R |
| 5,190,003 | 3/1993 | Voigt | 123/195 R |
| 5,253,615 | 10/1993 | Heater et al. . | |
| 5,501,189 | 3/1996 | Van Bezeij | 123/193.1 |
| 5,664,538 | 9/1997 | Hutchins | 123/195 R |

*Primary Examiner*—Henry C. Yuen
*Assistant Examiner*—Hai Huynh
*Attorney, Agent, or Firm*—Jerome R. Drouillard

[57] ABSTRACT

An internal combustion engine includes separated oil drain-back and crankcase ventilation passages. The oil drain-back passages extend from the cylinder head to a position below the top level of oil in the engine's crankcase. The crankcase ventilation passages extend from passages formed in the main bearing bulkheads from positions above the oil level in the crankcase and ultimately through the cylinder head. Oil dams surrounding the uppermost portions of the crankcase ventilation passages prevent oil from running downwardly through the crankcase ventilation passages.

11 Claims, 2 Drawing Sheets

INTERNAL COMBUSTON ENGINE HAVING SEPARATED CYLINDER HEAD OIL DRAINS AND CRANKCASE VENTILATION PASSAGES

GOVERNMENT RIGHTS

This invention was made with Government support under NREL Subcontract NO. ZCB-4-13032-02 Prime Contract No. DE-AC36-83CH10093 awarded by the Department of Energy. The Government has certain rights in this invention.

BACKGROUND OF THE INVENTION

The present invention relates to a system for separating the oil drain-back passages and crankcase ventilation passages in an internal combustion engine.

DISCLOSURE INFORMATION

The working gases of an internal combustion engine are generally confined to the combustion chamber and the intake and exhaust ports. A small portion of the working gases, however, escapes from the combustion chamber past the piston rings to the crankcase. These gases are referred to as blow-by and are vented back to the intake system to be recycled through the combustion process. A convenient manner for accomplishing this venting requires that the gases pass upwardly through passages in the engine block and cylinder head. Then, the gases are collected from under a camshaft or rocker arm cover.

Of course, lubrication of the bearings and sliding surfaces is a required function in an engine. And, lubrication must be furnished to the upper portion of the engine, including the valve gear, such as camshafts, rocker arms, finger followers, lash adjusters, valve lifters, and other types of hardware known to those skilled in the art and suggested by this disclosure. Lubrication oil is fed from the oil sump via a pump through pressurized passages to the cylinder block and the cylinder head. In the cylinder head, the oil lubricates the camshaft bearings and other valve gear and then drains back to the oil sump.

In current state-of-the-art engines, the crankcase ventilation and oil drain functions utilize the same internal passages. That is, oil drains down from the cylinder head to the sump, generally flowing down the walls of the passage, while blow-by gases are vented up from the crankcase and through the cylinder head, generally flowing up the center of the passage. In such a system the rising blow-by gases can entrain small oil droplets from the oil flow that is draining down to the oil sump. As some of this entrained oil gets past the oil separator it flows into the intake system and contributes to deposits and fouling which adversely effects engine durability. Another shortcoming is that oil foaming can occur from the blow-by gases flowing past the draining oil. Both of these problems contribute to oil oxidation and contamination, which can be detrimental to engine life.

The present solution to the problems caused by common crankcase ventilation and oil drain passages is to separate the passages that vent the crankcase gases to the cylinder head from those passages which drain the oil from the cylinder head to the oil sump while, still using internal passages. Although internal, yet separate, crankcase vents and oil drains has been previously attempted, this earlier effort relied on inclination of the engine to concentrate the oil drainage function on the front passages and the venting function to the rear passages. Unfortunately, the engine had no geometrical features which force the oil to drain in one set of passages while crankcase gases are vented in another set of passages. As such, if the angle of inclination of the engine is not proper, the system will be defeated. Other engines have been known to use external passages to separate the venting and drainage functions. External passages present several shortcomings however, because they generally lack long term durability, they are more expensive, they increase weight, and they increase the warm-up time of the engine compared to an engine with internal passages.

SUMMARY OF THE INVENTION

According to the present invention, an internal combustion engine includes a cylinder block, a cylinder head mounted upon the cylinder block, with the cylinder head having an upper deck extending generally parallel to a cylinder block mating surface of the cylinder head, and a crankcase containing a supply of oil for lubricating the engine. A plurality of oil drain-back passages extends from an oil submerged position within the crankcase and through the cylinder block and cylinder head, with the passages emerging from the cylinder head's upper deck. A plurality of crankcase vent passages extends from the crankcase at positions which are above the oil level and through the cylinder block and cylinder head, with the crankcase vent passages emerging from the cylinder head at positions which are above the upper deck.

Portions of the oil drain-back passages and the crankcase vent passages may conveniently be formed in main bearing bulkheads of the engine. As an aid to manufacturing, these passages may have identical geometries, at least as far as the cylinder block itself is concerned.

According to another aspect of the present invention, portions of the oil drain-back passages and the crankcase vent passages may comprise main bearing cap retaining bolt passages formed in the cylinder block. Portions of the oil drain-back passages and the crankcase vent passages are preferably formed in a bedplate attached to a lower surface of the cylinder block.

A system according to the present invention offers the advantage that separation of the venting and drainage functions is assured at any desired engine inclination.

An engine constructed according to the present specification will benefit from less sludging of the intake manifold and inlet valves, because less oil will be entrained in the inlet air entering the engine's cylinders. In addition, oil drainage to the sump is ensured for a wide range of engine inclinations and any rate of blowby flow.

DETAILED DESCRIPTION OF PREFERRED EMBODIMENTS

Figure 1:
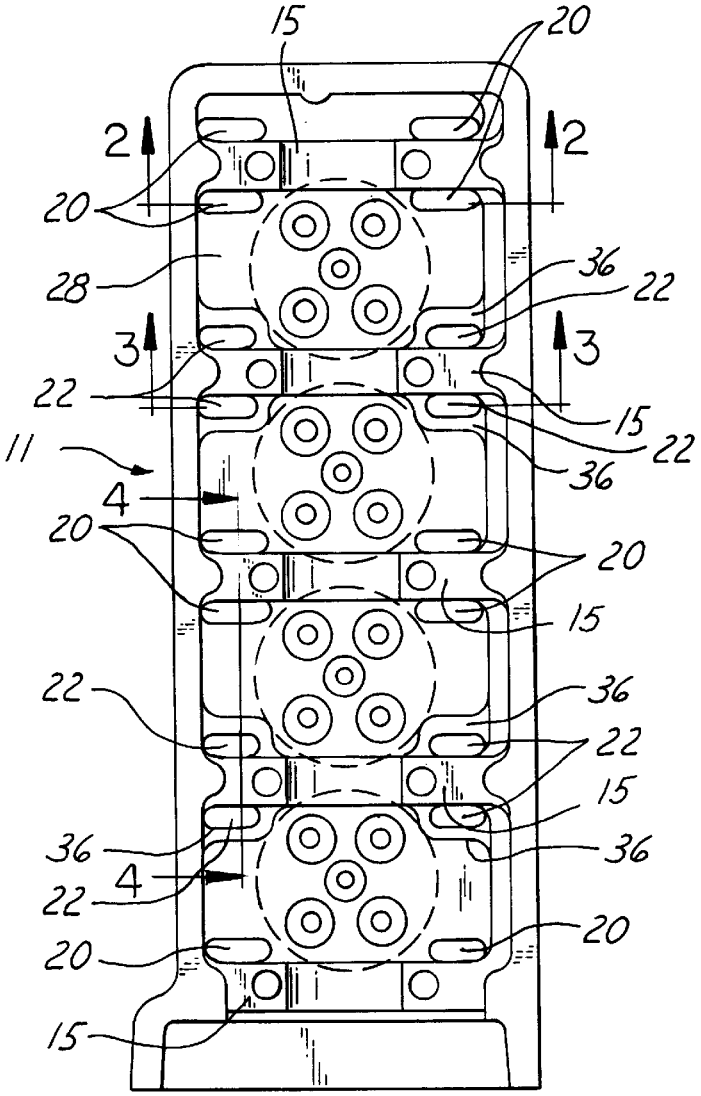
FIG. 1 is a plan view of an engine cylinder head having passages according to the present invention.

FIG. 1 is a plan view of engine cylinder head 12 according to the present invention, which is shown in this example as an inline-4 cylinder engine. Those skilled in the art will appreciate, in view of this disclosure, that the present inventive concept applies to engines with any number of cylinders. FIG. 1 shows the uppermost parts of a plurality of oil drain-back passages 20, which extend through cylinder head 12. Note that passages 20 are located on opposite sides of some of cylinder head bolt bosses 15. The purpose of oil drain-back passages 20 is to permit lubricating oil which has been furnished to the valve gear (not shown) which is mounted on top of cylinder head 12 in the upper part of the engine to return to the crankcase (FIG. 2).

FIG. 1 further illustrates a plurality of crankcase vent passages 22, which are located on opposite sides of the remaining head bolt bosses 15. The purpose of crankcase vent passages 22 is to permit blow-by gases to exit the crankcase without coming in contact with lubricating oil draining down from cylinder head 12.

Figure 2:
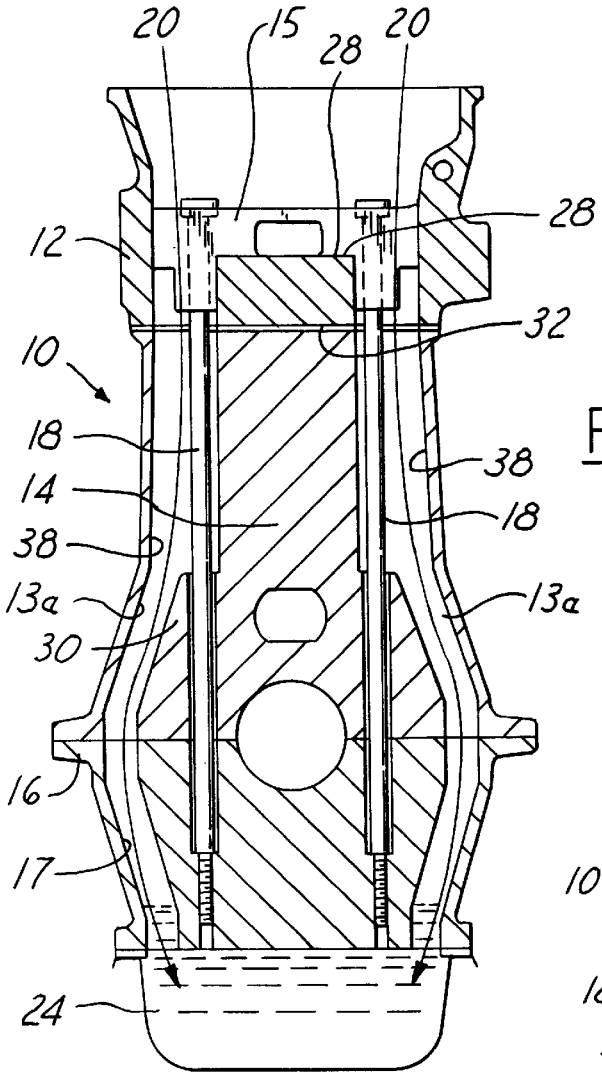
FIG. 2 is a section of a engine having a cylinder head, cylinder block, and bedplate according to the present invention. The portion of FIG. 2 pertaining to the cylinder head is taken along line 2—2 of FIG. 1.

FIG. 2 shows a cross-section of FIG. 1 in a plane containing oil drain-back passages 20. Oil flowing from the upper part of the engine falls upon upper deck 28 and then flows through the portion of passages 20 in cylinder head 12 which adjoin head bolt bosses 15. Then, the oil falls through bolt passages 38 formed in cylinder block 14 and into passages 13*a* formed in the cylinder block's main bearing bulkheads. Thereafter, the oil passes through passages 17 formed in bedplate 16 and into oil pan 24. Because the lower outlets of passages 17 extend below the top level of oil 26 within the crankcase, the blowby gases cannot escape from the crankcase through oil drain passages 20. Thus, blowby gases are not entrained in the oil, which reduces the possibility of oil foaming. This result is desirable, because oil foaming can lead to inadequate lubrication of bearing surfaces. An additional benefit resides in the fact that oil is not entrained in the blowby gases, which may cause intake system deposits and fouling.

Figure 3:
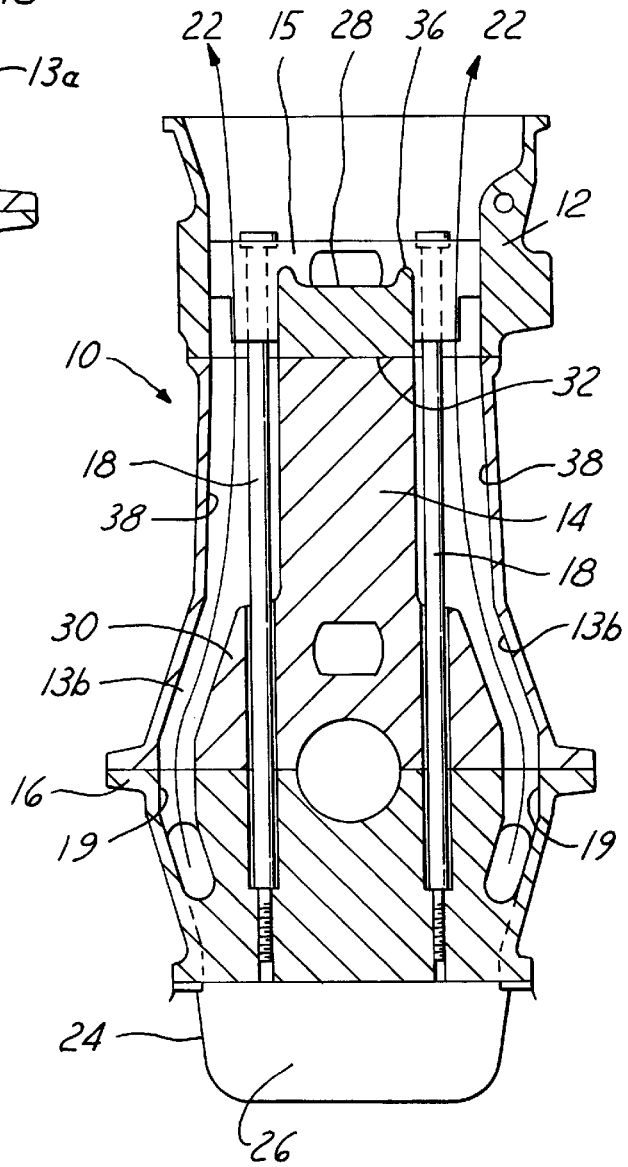
FIG. 3 is a second section of a engine having a cylinder head, cylinder block, and bedplate according to the present invention. The portion of FIG. 3 pertaining to the cylinder head is taken along line 3—3 of FIG. 1.

FIG. 3 shows a cross-section of FIG. 1 in a plane containing crankcase vent passages 22. The construction of crankcase vent passages 22 is such that the bottom portions of passages 22 are above the uppermost level of oil 26 within oil pan 24. Beginning with passages 19 formed in bedplate 16, crankcase gases pass through the bedplate and into passages 13*b* formed in cylinder block 14. The geometrical configuration and size of passages 13*a* and 13*b* are identical, which is desirable for ease of manufacturing. Having flowed through passages 13*b*, the crankcase gases pass through bolt passages 38 and up through cylinder head 12.

Figure 4:
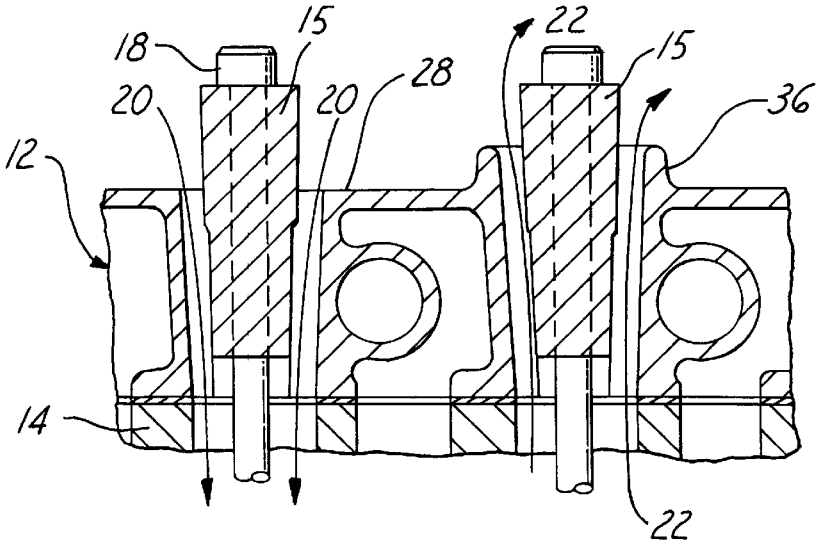
FIG. 4 illustrates a section of a cylinder head and the uppermost portion of a cylinder block according to the present invention. This Figure is taken along the line 4—4 of FIG. 1.

FIG. 4 illustrates an important difference between oil drain-back passages 20 and crankcase vent passages 22. In order to prevent oil and crankcase gases from mixing as gases pass upwardly through passages 22, an oil dam 36 is positioned about the upper portion of each of passages 22. Dams 36, which are formed integrally as part of the base casting of cylinder head 12, prevent oil from flowing from upper deck 28 into passages 22.

Construction of an engine in the manner herein described assures separated crankcase venting and oil drainage functions at any desired angle of the engine. The distances of the top of the passages above the cylinder head deck and the bottom of the passages from the bottom of the engine determine the maximum angle to which the engine can be inclined and still have separate venting and oil drainage functions. These distances may of course be adjusted to accommodate various engine mounting attitudes.

As noted above, crankcase vent passages 22 and the drain passages 20 can be identical in cylinder block 14. This is useful in an engine with a short-skirted cylinder block and a bedplate because the bedplate and cylinder head determine the function of the passages.

Although the present invention is illustrated as being applied to an engine with through-bolted construction where long bolts extend into and clamp together the cylinder head, block, and bedplate instead of using two separate sets of bolts, one clamping the cylinder head to the block and another set clamping the bedplate (or crankshaft main bearing caps) to the block, the present invention may be employed with other types of engines known to those skilled in the art and suggested by this disclosure.

We claim:

1. An internal combustion engine, comprising:

a cylinder block;

a cylinder head mounted upon the cylinder block, with said cylinder head having an upper deck for collecting oil furnished to the upper part of the engine;

a crankcase containing a supply of oil for lubricating the engine;

at least one oil drain-back passage extending from a submerged position within the crankcase and through the cylinder block and the upper deck; and at least one crankcase vent passage extending from the crankcase at a position which is above the oil level and through the cylinder block and cylinder head, with the crankcase vent passage emerging from the cylinder head at a position which is above the upper deck.

2. An engine according to claim 1, wherein portions of said oil drain-back passage and said crankcase vent passage are formed in main bearing bulkheads of said engine.

3. An engine according to claim 2, wherein the portions of said oil drain-back passage and said crankcase vent passage which are formed in the main bearing bulkheads of the engine have identical geometrical configurations.

4. An engine according to claim 1, wherein portions of said oil drain-back passage and said crankcase vent passage comprise bed plate retaining bolt passages formed in said cylinder block.

5. An engine according to claim 4, wherein said portions of said oil drain-back passage and said crankcase vent passage comprising bed plate retaining bolt passages are formed in main bearing bulkheads of said cylinder block.

6. An engine according to claim 1, wherein portions of said oil drain-back passage and said crankcase vent passage are formed in a bedplate attached to a lower surface of said cylinder block.

7. An engine according to claim 6, wherein the cylinder head, the cylinder block, and the bedplate are fastened together by means of a plurality of bolts extending through the cylinder head and cylinder block and into the bedplate.

8. An engine according to claim 1, having a plurality of said oil drain-back passages and a plurality of said crankcase vent passages.

9. A multicylinder internal combustion engine, comprising:

a cylinder block;

a cylinder head mounted upon an upper portion of the cylinder block, with said cylinder head having an upper deck extending generally parallel to a cylinder block mating surface of the cylinder head;

a crankcase containing a supply of oil for lubricating the engine;

a main bearing bedplate secured upon a lower portion of the cylinder block;

a plurality of oil drain-back passages extending within the main bearing bedplate from a submerged position within the crankcase and into passages formed in main bearing bulkheads of the cylinder block, with said oil drain-back passages further extending through the cylinder head and terminating at the upper deck; and a plurality of crankcase vent passages extending from the crankcase within the main bearing bedplate at positions which are above the crankcase oil level and into passages formed in main bearing bulkheads of the cylinder block, with said crankcase vent passages further extending through the cylinder head and emerging from the cylinder head at positions which are above the upper deck and protected by oil dams, such that oil is prevented from flowing downwardly through the crankcase vent passages.

10. An engine according to claim 9, wherein the cylinder head, the cylinder block, and the bedplate are fastened together by at least one bolt extending through the cylinder head and through one of the drain-back passages formed in the cylinder block and into the bedplate, and at least one bolt extending through the cylinder head and through one of the crankcase vent passages formed in the cylinder block and into the bedplate.

11. An engine according to claim 9, wherein two of said oil drain-back passages and two of said crankcase vent passages are disposed about the location of each cylinder.

* * * * *